United States Patent [19]

Combes et al.

[11] 4,083,219

[45] Apr. 11, 1978

[54] APPARATUS AND METHOD FOR FORMING CYLINDRICAL VALVE HUBS

[75] Inventors: Marvin G. Combes, Castro Valley; Roger L. Ripert, Concord, both of Calif.

[73] Assignee: Grove Valve and Regulator Company, Oakland, Calif.

[21] Appl. No.: 737,711

[22] Filed: Nov. 1, 1976

[51] Int. Cl.[2] ..... B21D 22/00

[52] U.S. Cl. ..... 72/352; 29/157 T

[58] Field of Search ..... 72/379, 352, 353, 354, 72/356, 358, 414, 445, 345; 29/157.1 R, 117.1 A, 157 T

[56] References Cited

U.S. PATENT DOCUMENTS

| | | | |
|---|---|---|---|
| 611,802 | 10/1898 | Taylor | 72/352 X |
| 691,454 | 1/1902 | Dier | 29/157 X |
| 2,883,744 | 4/1959 | Barnhart | 72/356 X |
| 2,932,338 | 4/1960 | Franck | 72/356 X |
| 3,643,322 | 2/1972 | Gerstle | 72/352 |

*Primary Examiner*—Leon Gilden

*Attorney, Agent, or Firm*—Melvin R. Stidham

[57] ABSTRACT

Apparatus and method for forming cylindrical tubular lateral extensions on cylindrical or oval body tube by swaging them from around an oval opening, which is narrower along the sides to compensate for the body curvature, the apparatus including a circular male swaging die with a profile that tapers at progressively decreasing angles to the stroke direction, i.e. a series of progressively steeper conical surfaces or a sphere. The die may be a complete ball which is rolled into a formed body tube; positioned over an opening therein and pushed therethrough by a ram driven through the opposite, aligned opening. The body tube may then be inverted and another ball rolled therein to be pushed through the opposite opening.

6 Claims, 10 Drawing Figures

APPARATUS AND METHOD FOR FORMING CYLINDRICAL VALVE HUBS

BACKGROUND OF THE INVENTION

In co-pending U.S. patent application Ser. No 736,830 filed Oct. 29, 1976 by Marvin G. Combes and Harold T. Ray for "Valve Body and Method of Forming Same" there is described and claimed a method wherein cylindrical hubs may be formed on a cylindrical or oval valve body or pipe or rolled steel plate by swaging out the metal around the openings cut in the valve body. The openings are of oval configuration, narrower along the body circumference, providing more material circumferentially to compensate for the curvature of the valve body, whereby when formed, the swaged hub ends will be substantially planar. Because the opening is oval prior to forming, a male swaging die circular in cross-section initially engages just the side edges and then, as penetration continues, the swaging action progresses circumferentially until a complete cylindrical tube is formed, with greater metal being swaged along the sides thereof. In the case of a conical die having a uniform taper, there is a relatively low load at the initial penetration of the die and an extremely high load after penetration progresses. Of course, it is the peak load which defines the demands on the forming equipment.

OBJECTS OF THE INVENTION

It is an object of this invention to provide a male swaging die which will minimize the peak load demands on the press.

It is a further object of this invention to provide a male swaging die which will require a lower total work load.

It is a further object of this invention to provide a quick, economical and practical method of swaging cylindrical valve body hubs.

Other objects and advantages of this invention will become apparent from the description to follow, particularly when read in conjunction with the accompanying drawings.

BRIEF SUMMARY OF THE INVENTION

In carrying out this invention, there is provided a male die, particularly for swaging a cylindrical hub from a cylindrical or oval valve body wherein the initial opening is of oval configuration providing more metal along the sides to compensate for the cylindrical configuration of the body itself. The die is formed with a profile decreasing in taper progressively toward a cylindrical surface in the direction of the die penetration. This could comprise a series of conical surfaces, each more nearly cylindrical than the previous one, or even a spherical surface. In one embodiment of the invention, the hubs are formed from an open-ended valve body tube by rolling a swaging ball into an open end until it engages a stop which positions it directly over the opening to be swaged, and then driving a ram down through the opposite aligned opening to punch the ball into a depending cylindrical female die below the body support. Then the body is inverted; another ball rolled into position over the opposite opening; and the ram again intorduced through the first opening to force the second ball into the depending cylindrical cavity. A special handling device is provided to slip around a ball and lift it and when the device is moved to a position wherein it embraces a railed track ramp, it deposits the ball thereon and allows it to roll into the valve body tube.

DESCRIPTION OF PREFERRED EMBODIMENTS

The Embodiment of FIGS. 1 to 5

Figure 1:
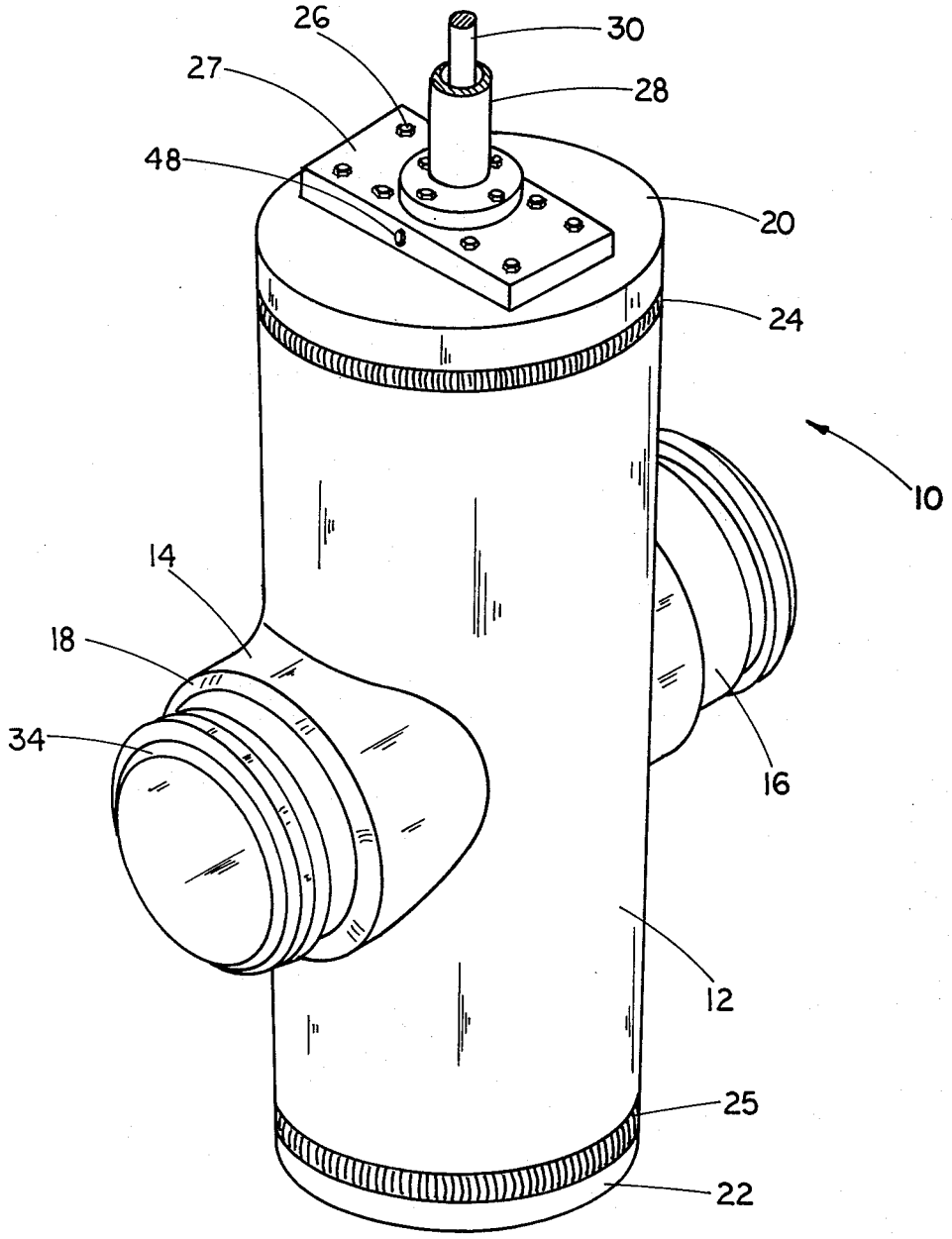
FIG. 1 is an isometric view of a gate valve manufactured in accordance with this invention.

Referring now to FIG. 1 with greater particularity, the gate valve 10 of this invention comprises a cylindrical valve body 12 of steel plate, pipe or the like, having outwardly swaged lateral extensions or hub retainers 14 in which are contained cylindrical hubs 16 welded at 18 to the hub retainers.

For simplicity of design and construction, the top and bottom closures 20 and 22 are planar circular members formed of relatively thick steel plate or the like secured to the ends of the valve body 12 by heavy welds 24 and 25.

Secured to the top closure 20, as by means of cap screws 26 is bonnet plate 27 of retangular configuration. A stem housing 28 is bolted to the top of the bonnet plate and the valve stem 30 is slidably accommodated in the bonnet plate 27 and the stem housing base 32.

Figure 2:
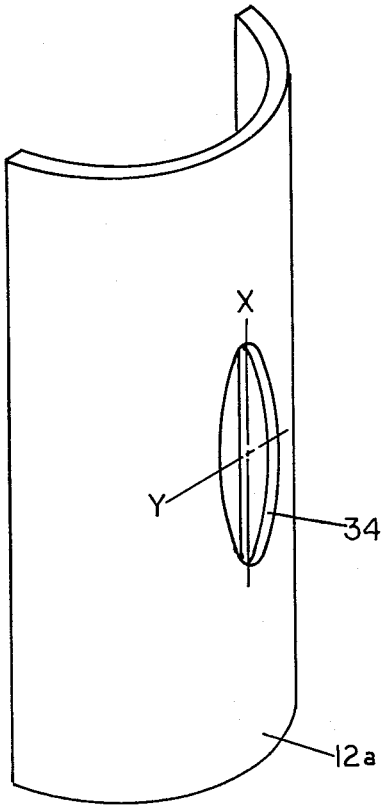
FIG. 2 is an isometric view of a semi-cylindrical valve body section prior to swaging.
Figure 5:
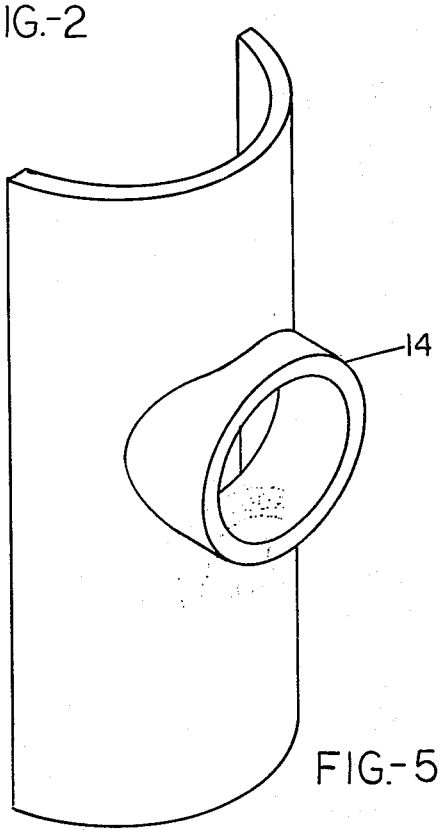
FIG. 5 is an isometric view of the semi-cylindrical body section after swaging.

Referring now to FIGS. 2 to 5, there is illustrated the method of forming the valve body 12 of FIGS. 1 and 2. As shown, the valve body may be formed in arcuate sections **12*a*, e.g. semi-cylindrical or semi-oval, as by rolling steel plates. An oval hole 34 is cut in the plate with the major axis X of the oval extending vertically, i.e. parallel to the axis of the arcuate section 12*a*. Then, the section 12*a* is placed in a saddle support 36 with a cylindrical depending female die cavity 38, and a ram R is driven down as indicated by arrow in FIG. 3 to swage the metal around the oval opening 34 outward, as indicated by the dotted lines to form a valve body section 12*a* with swaged hub portions 14, as illustrated in FIG. 5. Because of the curvature of the body section 12*a*, the metal along the circumference, displaced from the axis X, starting with the along the axis Y, has to be swaged outward further in order for the annular outer surface of the hub 14 to lie substantially in a single plane. Accordingly, the opening 34 is originally formed as an oval, of a shape and with dimensions to compensate for the curvature of the arcuate body section 12*a*** and determined by the radii of the bends.

After the hub portions 14 and hub extension 16 are welded in place, the semi-cylindrical body sections 12*a* and 12*b* are welded together along their complementary edges to form a complete curved valve body. Thereafter, the top and bottom end closures 20 and 22 are welded in place at 24 and 25, respectively.

Because of the oval configuration of the opening 34 initial engagement of a circular die 40 carried on the ram R will be along the minor axis Y against the narrower side edges of the oval opening 34. Because metal around just a part of the opening 34 is swaged at the early stages of the operation, the die 40 is profiled to maximize the work performed initially, by making the force vector more direct, and then progressively reducing the load to minimize the peak load and total work. Specifically, in FIG. 3 the die 40 is formed with a spherical profile 40*a* whereby at the initial stages of the operation, the force vector delivered by the die 40 against the valve body section 12*a* is nearly in the stroke direction indicated by the arrow. Then, as the stroke continues, and engagement becomes more nearly circumferential, the force vector rotates to a gradually more acute wedging action. The result is a much more efficient operation than is realized with a frustoconical die having a uniform taper corresponding to a rotated tangent of the spherical profile.

Figure 3:
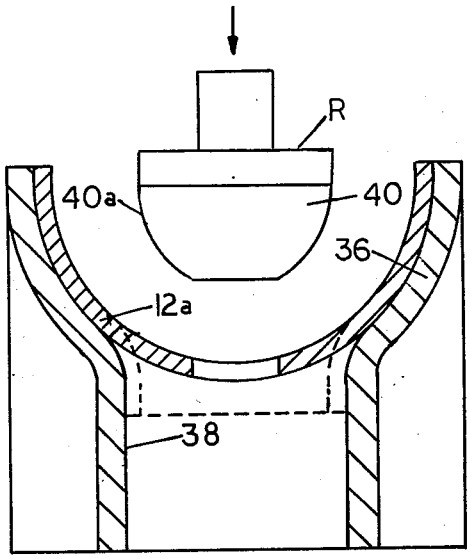
FIG. 3 is a more or less schematic view showing the swaging operation and a swaging die embodiment.
Figure 4:
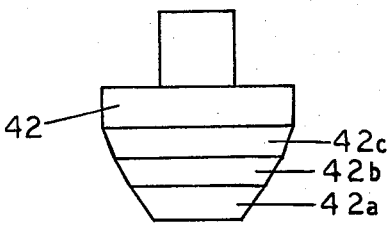
FIG. 4 is side view of another swaging die embodiment.

Referring now to FIG. 4 there is shown another form of die 42 which has a compound conical surface with a series of merging profiles 42*a*, 42*b* and 42*c* of gradually steeper frustoconical configuration, thus approaching the spherical profile of FIG. 3.

The Embodiment of FIGS. 6 to 10

Figure 6:
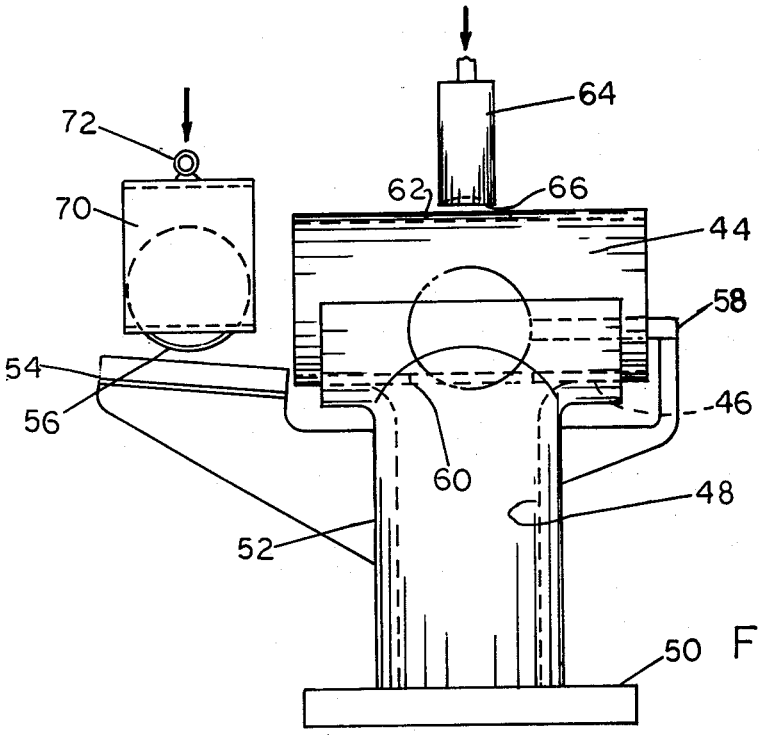
FIG. 6 is a side view of another swaging apparatus and swaging die embodiments.
Figure 7:
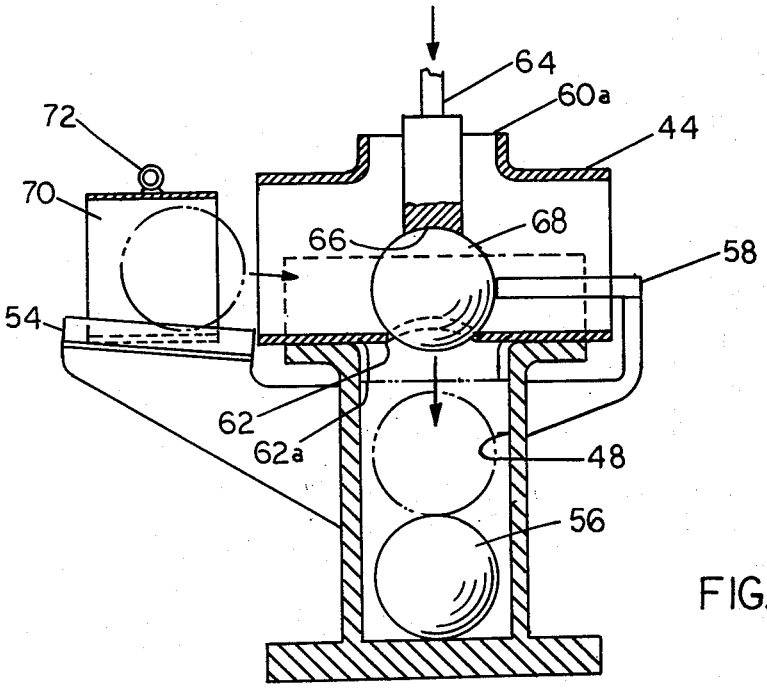
FIG. 7 is a section view of the swaging apparatus of FIG. 6 is subsequent stage of operation.

Referring now to FIGS. 6 and 7, there is shown a form of die and method which may be used to form hubs on a valve body section or, as shown, on a complete body tube 44, which may be rectangular or of closed cylindrical or oval configuration.

Figure 10:
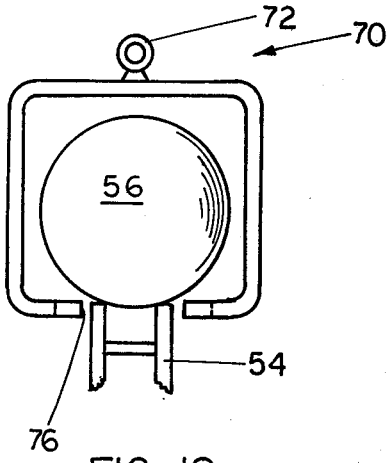
FIG. 10 is a partial view of the handler placing a swaging ball on a loading ramp.

The body tube 44 is placed on a saddle-like female die 46 having a cylindrical female die cavity 48 depending therefrom, the die and cavity chamber being supported on a suitable base 50. Extending from the side of the die is a track 54 which, as shown in FIGS. 7 and 10 may comprise a pair of parallel rails sloping downward from left to right to form a loading ramp. Hence, a first swaging ball 56, which is of a diameter equal to the ultimate internal diameter of the hub being swaged, may be placed on the rails 54 and allowed to roll down and into the body tube 44 until it engages a suitable stop 58 to position it directly over the opening 60 formed in the body tube. When so positioned, a ram 64 which may have a concave leading surface 66 is driven down through the opposite valve body opening 62 to drive the first ball 56 through the opening 60 and into the cylindrical cavity 48, forming the first hub 60*a*.

After the first cylindrical hub 60*a* is formed, the body tube 44 is inverted, as shown in FIG. 7; another ball 68 is rolled into the body tube until positioned by the stop 58; and the ram 64 is brought down through the now upper hub 60*a* to drive the ball 68 through the second opening 62 and into the cylindrical cavity 48, forming the second hub 62*a*. After the hubs 60*a* and 62*a* are so formed, the body tube 44 is formed from the support 46 and the swaging balls 56 and 68 are retrieved.

Figure 8:
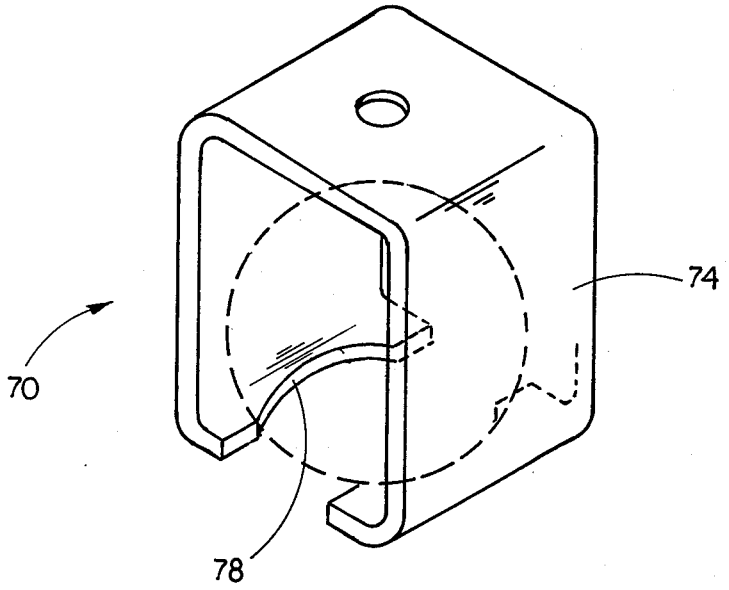
FIG. 8 is an isometric view of a swaging ball handler.
Figure 9:
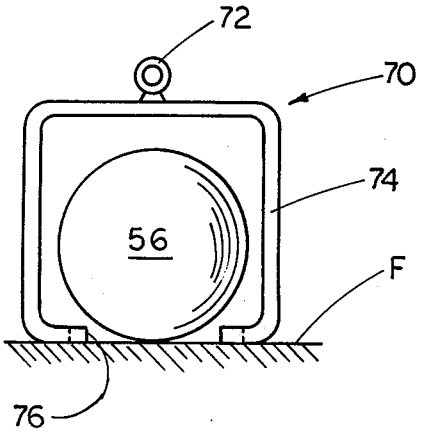
FIG. 9 is an end view of the handler in position to lift a ball.

Referring more particularly to FIGS. 8 to 10, there is shown a handle tool 70, which is particularly adapted to lift and transport the swaging balls 56 and 68. The tool includes suitable means 72 to be engaged by a lifting mechanism (not shown) and has depending legs 74, which are spaced to fit freely around a swaging ball 56, 68 and inturned feet 76 which extend thereunder. The feet 76 have arcuate portions 78 cut therefrom whereby a ball 56 or 68 will seat therein in fixed position.

In operation, the ball handler 70 may be lowered to the floor F and moved laterally over the swaging ball 56. Then, when lifted, the ball 56 is nested in the arcuate cut-outs 78 and the ball is lifted to the rail ramp 54. The feet 76 are spaced sufficiently to embrace the ramp of the rails 54 whereby the holder 70 may be lowered to deposit the ball on the rail 74 and allow it to roll into position in the body tube 44, as above described.

While this invention has been described in conjunction with preferred embodiments thereof, it is obvious that further modifications and changes therein may be made by those skilled in the art without departing from the spirit and scope of this invention as defined by the claims appended hereto.

What is claimed as invention is:

1. Apparatus for swaging cylindrical, tubular radial extensions on a curvilinear open-ended tube pre-formed with a pair of opposite oval openings therein, the major axes of which are parallel to the axis of curvation of the curvilinear member; said apparatus comprising;

a concave saddle support for said member having depending therefrom a cylindrical cavity;

a swaging ball of a diameter to be received freely in said cavity;

means for rolling said swaging ball into an open end of said tube;

means for locating said ball over one of said oval openings; and force applying means directed through the other oval opening for pushing said ball through said one oval opening to swage material therearound outward.

2. The swaging apparatus defined by claim 1 wherein: said force-applying means is a ram having a concave leading surface.

3. The swaging apparatus defined by claim 1 including:

a ramp track mounted adjacent said saddle support sloping downward toward and open-ended tube supported thereon.

4. The swaging apparatus defined by claim 3 including a ball lifting device comprising:

a pair of generally upright legs spaced to receive a swaging ball therein:

a pair of support feet extending inwardly toward each other from the bottom of said upright legs;

arcuate recesses in the ends of said support members for seating a swaging ball therein:

said support members being spaced apart further than the width of said ramp track; and means on said lifting device adapting it to be gripped by a lifting member.

5. The swaging apparatus defined by claim 4 wherein: said ball lifting device is configurated as an open ended box of a size to receive a swaging ball freely therein.

6. The swaging apparatus defined by claim 1 wherein said locating means comprises:

a stop member positioned to extend into the opposite open end of said tube to be engaged by the rolling swaging ball.

* * * * *